United States Patent [19]

Okamoto

[11] Patent Number: 4,641,564

[45] Date of Patent: Feb. 10, 1987

[54] MUSICAL TONE PRODUCING DEVICE OF WAVEFORM MEMORY READOUT TYPE

[75] Inventor: Shimaji Okamoto, Shizuoka, Japan

[73] Assignee: Nippon Gakki Seizo Kabushiki Kaisha, Hamamatsu, Japan

[21] Appl. No.: 621,246

[22] Filed: Jun. 15, 1984

[30] Foreign Application Priority Data

Jun. 17, 1983 [JP] Japan ..... 58-109945
Mar. 3, 1984 [JP] Japan ..... 59-40720

[51] Int. Cl.[4] ..... G10H 1/06

[52] U.S. Cl. ..... 84/1.22; 84/1.23; 84/DIG. 9; 84/1.01; 84/1.19

[58] Field of Search ..... 84/1.22, 1.19, 1.01, 84/1.23, DIG. 9

[56] References Cited

U.S. PATENT DOCUMENTS 4,281,574 8/1981 Deutsch ..... 84/1.22
4,352,312 10/1982 Whitefield et al. ..... 84/1.22
4,437,379 3/1984 Okumura et al. ..... 84/1.01

*Primary Examiner*—William M. Shoop, Jr.

*Assistant Examiner*—Sharon D. Logan

*Attorney, Agent, or Firm*—Blakely, Sokoloff, Taylor & Zafman

[57] ABSTRACT

A musical tone producing device of a waveform readout type has a reference waveform memory and a difference waveform memory.

The reference waveform memory stores a reference waveform which is similar commonly to each of divided waveforms belonging to a plurality of blocks into which a musical tone waveform of a musical tone to be produced is divided.

The difference waveform memory stores difference waveforms, each of which is a difference between the reference waveform and each of divided waveforms.

The reproduction of the musical tone waveform is accomplished by reading out the reference waveform and the difference waveforms successively and by successively adding the read out reference waveform and the difference waveforms. This musical tone waveform synthesis according to utilization of difference waveforms contributes to the reduction of memory size.

19 Claims, 28 Drawing Figures

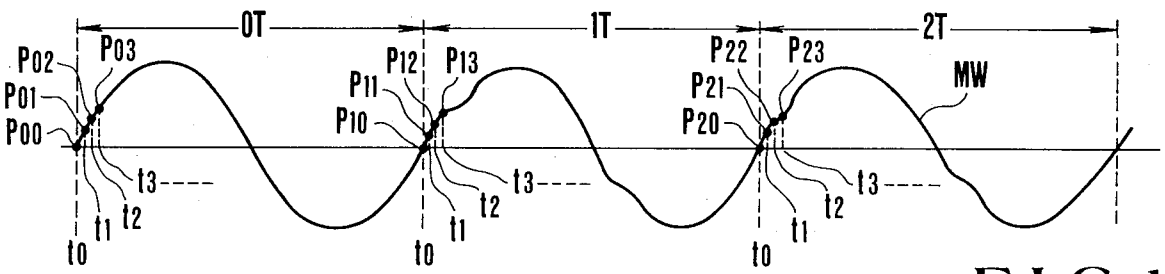
FIG. 1
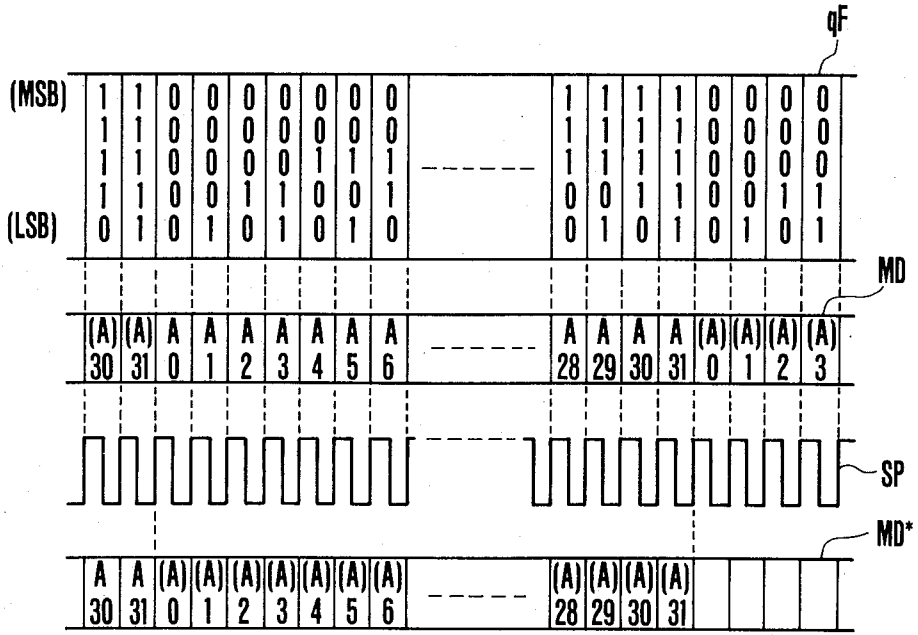
FIG. 4A
FIG. 4B
FIG. 4C
FIG. 4D

FIG.3A
FIG.3B
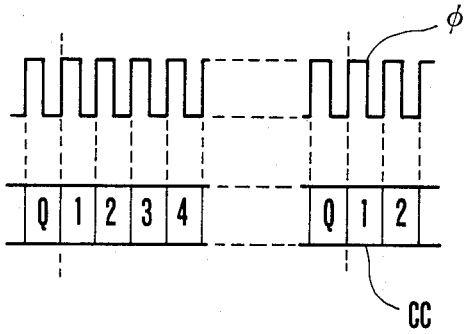
FIG.5A
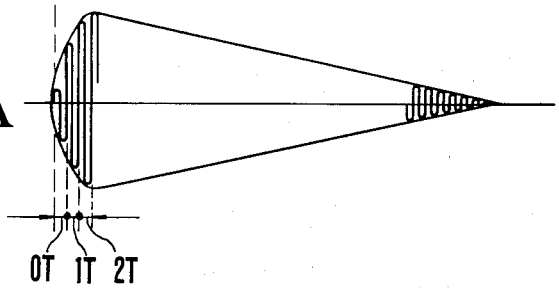
FIG.5B
FIG.5C
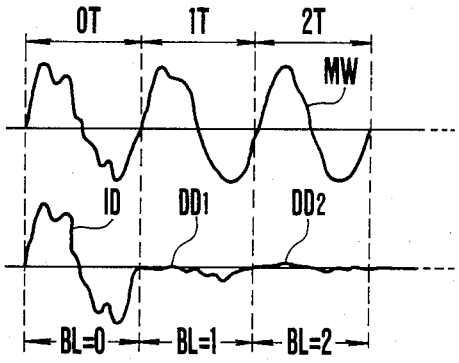
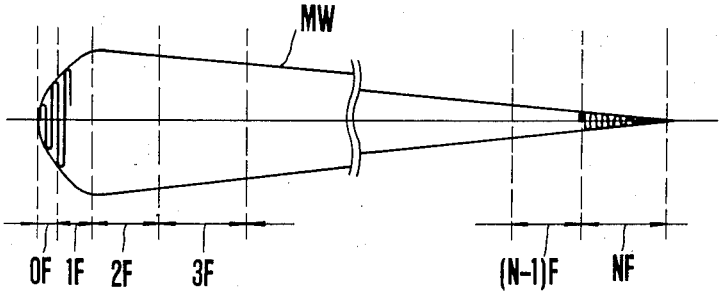
FIG.7

MUSICAL TONE PRODUCING DEVICE OF WAVEFORM MEMORY READOUT TYPE

BACKGROUND OF THE INVENTION

The present invention relates to a musical tone producing device and, more particularly, to a musical tone producing device of waveform memory readout type.

A musical tone producing device of this type is used as a musical tone generator such as an electronic musical instrument. The musical tone producing device is used to generate a musical tone signal whose waveform (tone color) elaborately changes in the same manner as tone colors of natural sounds produced by conventional musical instruments. For this purpose, a musical tone producing device is proposed, wherein waveform data of sampling points of the entire musical tone signal waveform from the beginning of the conventional musical tone to its end are stored in a waveform memory, and the waveform data of the respective sampling points are sequentially read out from the waveform memory to produce a musical tone signal. Such an example is shown in FIG. 3 of U.S. Pat. No. 4,383,462. In FIG. 3, a complete waveform of the period from the beginning till the end of a tone production is memorized to be read out subsequently. The complete waveform is stored in the WM31 and the waveform is read out based on a signal (KD) indicative of a key depression timing.

According to the technique described above, when waveform data obtained by sampling a tone of a conventional musical instrument are stored in the waveform memory, the same tones as in the conventional musical instrument can be produced. However, the amount of data to be stored in the waveform memory becomes large, and a compact, low-cost musical tone producing device cannot be obtained. It is thus desirable to decrease the capacity of the waveform memory.

In order to solve the above problem, a method of decreasing the capacity of the waveform memory is also proposed, wherein waveform data corresponding to a repeating waveform (i.e., waveform portions of the entire waveform which are periodically repeated) is stored in the waveform memory and is read out repeatedly. Such an example is shown in FIG. 6 of U.S. Pat. No. 4,383,462. In the WM61 in said FIG. 6 is stored a complete waveform of the attack period and the attack waveform is read therefrom based on a key depression (a KD signal). After the reading out of the attack waveform (an IMF signal) until the finishing of a tone production (a DF signal), the musical tone waveform of the fundamental period is read out repeatedly.

According to this technique, however, since waveform data to be stored in the waveform memory are basically obtained by sampling the amplitude of the musical tone waveform, the musical tone generated from the musical tone producing device becomes artificial. As a result, monotonous expressions in musical performance cannot be avoided.

In addition to the above disadvantage, according to this technique, the waveform data normally requires a number of bits to represent a maximum amplitude of the waveform. As a result, the capacity of the waveform memory must be increased.

In order to solve the above problem, a method of decreasing the capacity of the waveform memory is described in U.S. Pat. No. 3,515,392, wherein differences between waveform amplitudes of every two adjacent sampling points of the tone signal waveform are sequentially calculated, and difference data are stored in the waveform memory. The number of bits which represents the difference data is then smaller than that which represents the maximum waveform amplitude, and the required number of bits represents only a change in waveform. Therefore, the capacity of the waveform memory can be decreased.

When this method of storing the difference data in the waveform memory is considered in detail, however, the waveform includes a moderate-slope waveform portion and an steep-slope waveform portion subjected to abrupt, complicated changes. The difference greatly changes from a small value (represented by a smaller number of bits) to a large value (represented by a larger number of bits) in the latter. Therefore, when the number of bits for the difference data is simply limited without consideration, the musical tone signal produced on the basis of the limited difference data presents an artificial tone, resulting in inconvenience.

SUMMARY OF THE INVENTION

The present invention has been made in consideration of the conventional drawbacks, and its principal object is to provide a musical tone producing device capable of producing a highly precise (high quality) tone signal by using a waveform memory of smaller capacity while an advantage is effectively utilized wherein difference data representing differences between every two adjacent sampling points of a musical tone signal waveform is stored in the waveform memory.

In order to achieve the above object of the present invention, a waveform having a plurality of successive periods of a musical tone signal to be produced is divided into a plurality of blocks (e.g., on a period unit). With respect to blocks following the first block, differences between waveform amplitudes of the respective sampling points of a given block and those of the corresponding sampling points of the immediately preceding block are calculated, and resultant difference data are in advance stored in the waveform memory. In this case, since the waveforms of the two adjacent blocks are extremely similar to each other, the differences between the amplitudes of the waveforms of the adjacent blocks are very small. Thus, the number of bits of the difference data may be small, as a result, the capacity of the waveform memory can be decreased.

On the other hand, when a musical tone signal is produced by using the waveform memory for storing such difference data, the waveform amplitude data of the respective sampling points of the first block are read out as initial waveform data by a proper means. Thereafter, waveform amplitude data of the respective sampling points of the second and subsequent blocks are obtained such that the difference data of the sampling points corresponding to those of initial data are subjected to addition or subtraction.

According to an aspect of the present invention, there is provided a musical tone producing device of a waveform readout type, comprising:

reference waveform memory means for storing reference waveform data constituting a reference waveform, the reference waveform being similar to each of divided waveforms belonging to a plurality of blocks into which a musical tone waveform of a musical tone to be produced is divided;

difference waveform memory means for storing difference waveform data which comprises a plurality of block difference waveform data, each of the block difference waveform data constituting difference waveform representing a difference between the reference waveform and each of the divided waveforms;

readout means connected to the reference waveform memory means and the difference waveform memory means for reading out the reference waveform data and for reading out successively the block difference waveform data;

adding means connected to the reference waveform memory means and the difference waveform memory means for adding the reference waveform data and each of the block difference waveform data and for outputting successively added results respectively corresponding to the divided waveforms; and sound means connected to the adding means for producing the musical tone according to the added results.

Other objects, features and advantages will be apparent from the following detailed description taken in conjunction with the accompanying drawings.

BRIEF DESCRIPTION OF THE DRAWINGS

FIG. 1 shows a signal waveform for explaining the principle of the present invention;

FIGS. 3A and 3B, FIGS. 4A to 4D, and FIGS. 5A to 5C respectively show waveforms of signals produced by the main parts of the device shown in FIG. 2;

FIG. 7 shows a signal waveform showing the relationship between the frame and a musical tone generated by the device shown in FIG. 6;

DETAILED DESCRIPTION OF THE PREFERRED EMBODIMENTS

Figure 2:
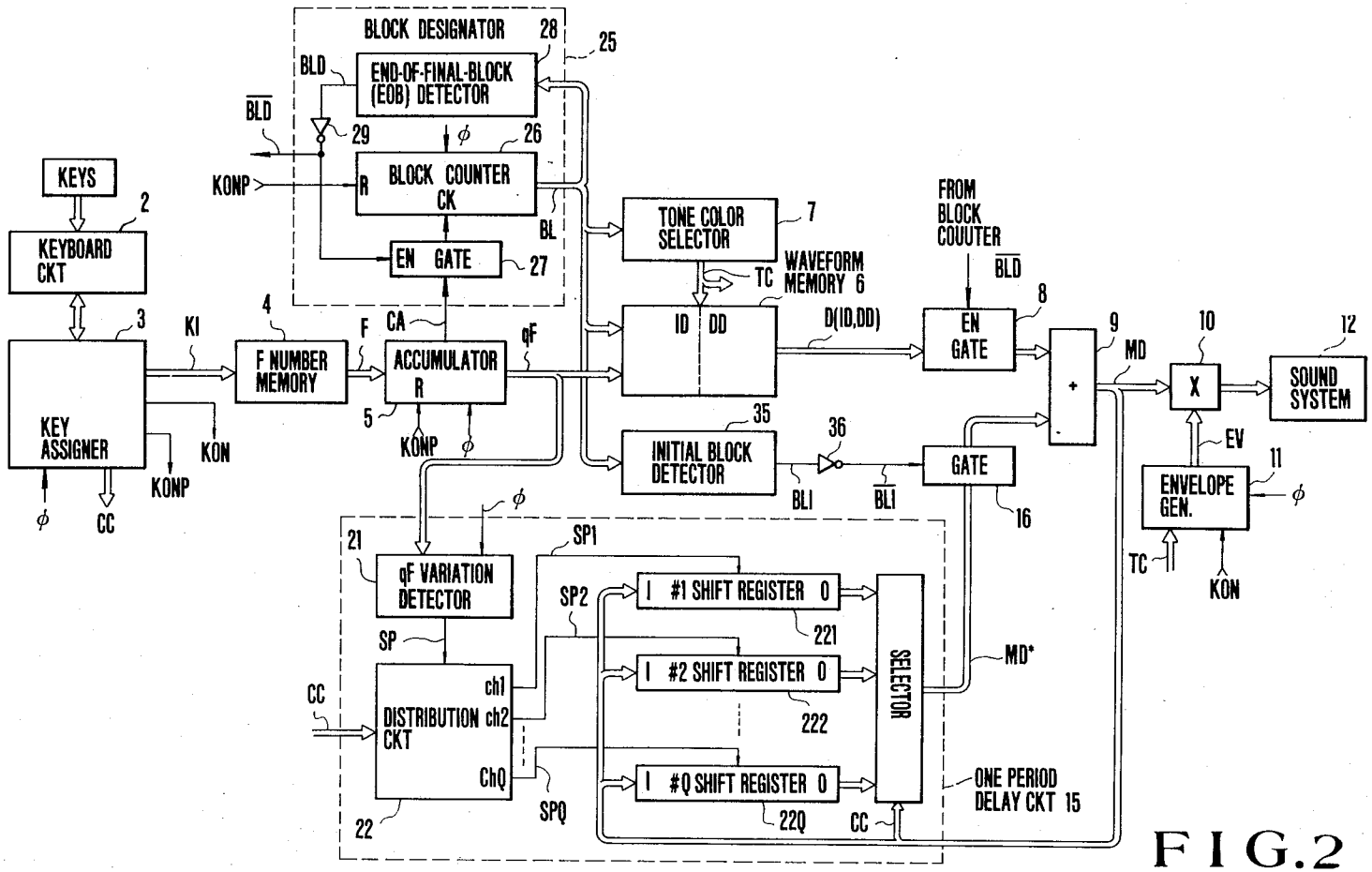
FIG. 2 is a block diagram of a musical tone producing device according to a first embodiment of the present invention.

In order to best understand the present invention, the principle of the present invention will be described with reference to FIG. 1. Assume periods 0T, 1T, 2T, . . . of a waveform MW of a musical tone signal to be produced. Changes in sampled values representing waveform amplitudes at sampling times t0, t1, t2, . . . of a given period are compared with those of the period adjacent to the given period.

The sampled values at times t0, t1, t2, . . . of the 0th, first and second periods 0T, 1T and 2T are given to be (P00, P01, P02, . . . ,), (P10, P11, P12, . . . ,) and (P20, P21, P22, . . . ,), respectively. When changes in sampled values of every two adjacent periods at the same relative sampling time are considered, differences between the sampled values are very small.

The sampled values P10, P11, . . . of the first period 1T at the respective times t0, t1, . . . are very similar to the sampled values P00, P01, . . . of the 0th period 0T at the respective times t0, t1, . . . . Differences between the sampled values P00 and P10 and between the sampled values P01 and P11 are very small. Similarly, in the relationship between the sampled values P20, P21, . . . of the second period 2T and the sampled values P10, P11, . . . of the first period 1T, differences between the sampled values P10 and P20 and between the sampled values P11 and P21 are very small. The differences between the corresponding sampled values of the every two adjacent periods after the third and subsequent periods are very small.

At the times t0, t1, t2, . . . of the first period 1T, differences D10, D11, D12, . . . are calculated as follows:

$$\left.\begin{array}{l} P10 - P00 = D10 \\ P11 - P01 = D11 \\ P12 - P02 = D12 \end{array}\right\} \quad (1)$$

$$\vdots$$

At the times t0, t1, t2, . . . of the second period 2T, differences D20, D21, D22, . . . are calculated as follows:

$$\left.\begin{array}{l} P20 - P10 = D20 \\ P21 - P11 = D21 \\ P22 - P12 = D22 \end{array}\right\} \quad (2)$$

$$\vdots$$

Similarly, the differences are calculated at the respective times t0, t1, t2, . . . of the third and subsequent periods.

Difference data of differences D10, D11, D12, . . . ; D20, D21, D22; . . . are stored in the waveform memory. The sampled values P10, P11, P12, . . . ; P20, P21, P22, . . . ; . . . of the respective periods 1T, 2T, . . . are sequentially generated.

The sampled values P10, P11, P12, . . . of the first period 1T are given as follows:

$$\left.\begin{array}{l} P10 = P00 + D10 \\ P11 = P01 + D11 \\ P12 = P02 + D12 \end{array}\right\} \quad (3)$$

$$\vdots$$

In this manner, the sampled values P00, P01, P02 of the 0th period 0T are added to the differences D10, D11, D12, . . . of the period 1T which are obtained by equations (1), respectively.

The sampled values P20, P21, P22, . . . of the second period 2T are given as follows:

$$\left.\begin{aligned} P20 &= P10 + D20 = P00 + (D10 + D20) \\ P21 &= P11 + D21 = P01 + (D11 + D21) \\ P22 &= P12 + D22 = P02 + (D12 + D22) \end{aligned}\right\} \quad (4)$$

$$\vdots$$

As is apparent from the above equations, the sampled values P10, P11, P12, . . . of the first period 1T which are derived from equations (3) are added to the differences D20, D21, D22, . . . of the second period 2T which are derived from equations (2), respectively. In this case, the sampled values P20, P21, P22, . . . have contents obtained by adding the sampled values P00, P01, P02, . . . of the 0th period 0T to sums of the differences D10, D11, D12, . . . of the first period 1T and the differences D20, D21, D22 of the second period 2T, respectively.

Similarly, the sampled values P30, P31, P32 of the third period 3T are calculated in the same manner as described above.

$$\left.\begin{aligned} P30 &= P20 + D30 = P00 + (D10 + D20 + D30) \\ P31 &= P21 + D31 = P01 + (D11 + D21 + D31) \\ P32 &= P22 + D32 = P02 + (D12 + D22 + D32) \end{aligned}\right\} \quad (5)$$

$$\vdots$$

As is apparent from equations (5), the sampled values P20, P21, P22, . . . of the second period 2T are added to the differences D30, D31, D32, . . . of the third period 3T, respectively.

The differences of a given subsequent period are added to the sampled values of the immediately preceding period to obtain the sampled values of the given period, respectively. In general, a sampled value Pni at the ith sampling time tni of the nth period nT is calculated as follows:

$$Pni = P0i + \sum_{n=1}^{n} Dni \quad (6)$$

The sampled values P00, P01, P02, . . . of the 0th period 0T are generated by a proper means (e.g., by reading out data of sampled values P00, P01, P02, . . . from the waveform memory).

The above-mentioned description has been made in favor of illustrative convenience. The present invention is not therefore limited to the case described above. Various changes and modifications may be made. For example, in the above explanation, the musical tone signal waveform MW is divided into blocks each having a single period. However, the block may also consist of two periods or a half period.

Musical tone producing devices according to the preferred embodiments of the present invention which are based on the principle described above will be described in detail hereinafter.

First Embodiment

FIG. 2 shows a first embodiment when a musical tone producing device is applied to a polyphonic electronic musical instrument for simultaneously producing a plurality of tones.

A key information KI generated from a keyboard circuit 2 upon depression of a key is detected and assigned to an empty one among Q time-division channels by a key assigner 3. Q corresponds to a maximum number of tones capable of producing simultaneously. The key assigner 3 receives a system clock $\phi$ shown in FIG. 3A and generates a channel signal CC (FIG. 3B) of each of the first to Qth channels for every one period of the system clock $\phi$. In each channel timing, the key assigner 3 generates key information KI assigned to the channel, a key on signal KON (logic "1" while the key is being depressed) of the depressed key and a key on pulse signal KONP (pulse set at logic "1" only during one-channel timing when the key on signal KON is set at logic "1") in a time-division manner.

Pieces of the key information KI generated from the key assigner 3 are sequentially supplied to an F number memory 4. The F number memory 4 sequentially generates numerical data (called F numbers) which respectively represent pitches of depressed keys on the basis of the pieces of the key information KI which are received by the F number memory 4 in a time-division manner. For example, the F number memory 4 stores digital data, i.e., 1.0000 (decimal) corresponding to a tone having a highest pitch. Digital data from the lowest pitch to the second highest pitch are represented by fractional values.

The F number signals sequentially read out from the F number memory 4 for the respective channels are supplied to an accumulator 5. The F number signals of the respective channels are initialized by the key on pulse signal KONP and are accumulated for every channel. Accumulated outputs qF representing integral parts of the accumulated values of the F number signals of the respective channels are generated in synchronism with the corresponding channel timings in a time-division manner. The higher the pitch becomes, the shorter a period of accumulated output qF becomes.

In this embodiment, the output qF from the accumulator 5 comprises 5-bit digital data which periodically varies from "00000" (0 in decimal notation) to "11111" (31 in decimal notation). When a cycle of changes of the accumulated output qF allows designation of 32 sampling points (i.e., the 0th to 31st sampling points), they can be designated at a speed corresponding to the pitches of the depressed keys. It should be noted that FIGS. 4A to 4D show a case for one channel.

The accumulated output qF is given as an address signal to a waveform memory 6. In this embodiment, data of sampled values P00, P01, P02, . . . , and P031 of the 0th period 0T described with reference to FIG. 1 are stored as initial waveform data ID in the waveform memory 6. The waveform memory 6 also stores difference waveform data DD corresponding to the differences D10, D11, D12, . . . ; D20, D21, D22, . . . ; . . . (described with reference to equations (1) and (2)) of the respective periods 1T, 2T, . . . . The waveform data ID and the difference waveform data DD are prepared for every tone color so as to cause a tone color selector 7 to select proper data. A set of the waveform data ID and the difference waveform data DD is selected by a tone color selection signal TC generated by the tone color selector 7. In this manner, the waveform data D (ID and DD) having 32 sampling points/period are read out from the waveform memory 6 and are supplied as a first addition input to an adder 9 through a gate 8 in every channel in a time-division manner.

The waveform memory 6 stores the initial waveform data ID (FIG. 5C) with block number "0" and the difference waveform data DD1, DD2, . . . (FIG. 5C) with block numbers "1", "2", . . . . The initial waveform data ID consists of data for 32 sampling points of a waveform (FIG. 5B) of the 0th period 0T. The waveform (FIG. 5B) of the 0th period 0T corresponds to the waveform (FIG. 5A) of the 0th period 0T which is generated from the conventional musical instrument. The block numbers "1", "2", . . . of the difference waveform data DD1, DD2, . . . correspond to the periods 1T, 2T, . . . , respectively, and comprises data for 32 sampling points each. When the respective sampling points included in the respective periods 0T, 1T, 2T, . . . are accessed, only a desired block number and a desired sampling point number are designated to read out desired data.

The waveforms shown in FIGS. 5B and 5C are illustrated such that the time base in FIG. 5A is expanded. The waveform in FIG. 5B is obtained such that the waveform in FIG. 5A is normalized and is corrected to a waveform having a constant amplitude from the beginning to the end. The normalized waveforms are stored as the waveform data ID, DD1, DD2, . . . in the waveform memory 6. However, the waveform data ID, DD1, DD2, . . . may also be directly derived from the waveform (FIG. 5A) without normalization and may be stored in the waveform memory 6.

A sum output from the adder 9 is supplied as musical tone waveform data MD to a multiplier 10 and is multiplied with an envelope signal EV from an envelope generator 11. A multiplied signal is converted by a sound system 12 to a musical tone. Meanwhile, the musical tone signal waveform data MD from the adder 9 is delayed by a one period delay circuit 15 by a delay time corresponding to one period. A delayed signal is fed back to a second addition input of the adder 9 through a gate 16. The adder 9 performs the operations given by equations (3) to (5) such that one-period delayed musical tone waveform data MD* are added to the waveform data D currently read out from the waveform memory 6. The musical tone waveform data MD at the respective sampling points during the current period are sequentially generated. In this case, the musical tone waveform data MD on the respective channels are generated in a time-division manner.

The one period delay circuit 15 has a qF variation detector 21 for receiving the accumulated output qF from the accumulator 5. The qF variation detector 21 generates a shift pulse SP (FIG. 4C) at a given channel timing when the contents of the accumulated outputs qF (FIG. 4A) of the given channel change. A change in accumulated output qF indicates that the sampling point has advanced by one step. Therefore, the shift pulse SP is generated every time the initial waveform data ID or the difference waveform data DD is read out from the waveform memory 6. The readout data are supplied to a distribution circuit 22. The distribution circuit 22 receives the channel signal CC supplied from the key assigner 3 and distributes the shift pulses SP generated from the qF variation detector 21 as shift trigger pulses SP1 to SPQ for the respective channel timings. The shift trigger pulses SP1 to SPQ are supplied to shift registers 221 to 22Q corresponding to the channels, respectively.

The shift registers 221 to 22Q are 32-stage shift registers, respectively. The 32 stages correspond to the 32 sampling points of one period of the musical tone waveform. The shift registers 221 to 22Q commonly receive the musical tone waveform data MD, which are supplied from the adder 9, every time the shift registers 221 to 22Q receive the shift trigger pulses SP1 to SPQ, respectively. The shift registers 221 to 22Q shift the data by one stage each. When the respective shift registers 221 to 22Q receive 32 shift trigger pulses SP1 to SPQ (i.e., when one cycle has elapsed), outputs from the shift registers 221 to 22Q are sequentially supplied to a selector 23. The selector 23 sequentially receives the outputs from the shift registers 221 to 22Q of the first to Qth channels one by one in response to the corresponding channel signals CC. The selector 23 then supplies the delayed musical tone waveform data MD* (FIG. 4D) obtained by delaying the musical tone waveform data MD by one period.

The addresses of the memory area of the waveform memory 6 for storing the initial waveform data ID and the difference waveform data DD for 32 sampling points/period are accessed in response to the accumulated outputs qF as described above. The designation of subsequent periods is performed by a block designation output BL from a block designation circuit 25.

The block designation circuit 25 has a block counter 26. The block counter 26 performs counting in response to a clock signal CA (generated in synchronism with the corresponding channel timing) generated as a carry signal through a gate 27 when the accumulated output qF from the accumulator 5 changes from "11111" to "00000". The block counter 26 receives the key on pulse signal KONP as a reset signal from the key assigner 3. The block counter 26 then supplies the block designation outputs BL to the waveform memory 6 so as to designate the blocks in order of 0, 1, 2, . . . after the block counter 26 receives the key on pulse signal KONP. It should be noted that the block counter 26 counts the clock signals CA in a time-division manner in synchronism with the respective channel timings and that the block designation outputs BL are also generated in the time-division manner.

The block numbers 0, 1, 2, . . . are assigned the periods 0T, 1T, 2T, . . . of the musical tone waveform MW, respectively.

The block designation circuit 25 supplies the block designation output BL to an end-of-final-block (EOB) detector 28. When the content of the block designation output BL designates a block next to the final block (i.e., when the final block is ended), a block detection output BLD of logic "1" is generated from the EOB detector 28. It should also be noted that this detection operation is performed in the time-division manner. The output BLD is inverted by an inverter 29, and an inverted output $\overline{BLD}$ is supplied to an enable terminal EN of the gate 27. In this manner, when the EOB detector 28 detects the EOB, the gate 27 is closed.

The output from the inverter 29 is simultaneously supplied to an enable terminal EN of the gate 8 connected to the output terminal of the waveform memory 6. When the EOB detector 28 detects the EOB, the gate 8 is closed. As a result, the waveform data D as the first addition input is not supplied to the adder 9, and thus the delayed musical tone waveform data MD* from the one period delay circuit 15 is supplied as the musical tone waveform data MD. When the EOB is detected, the musical tone waveform data MD formed by the EOB is repeatedly supplied to the sound system 12.

The block designation output BL is supplied to an initial block detector 35 and generates an initial block detection output BL1 which is set to be logic "1" when the block designation output BL is set to be logic "0".

The output BL1 is inverted by an inverter 36, and an inverted output BL1 is supplied to an enable terminal EN of a gate 16. The gate 16 is disabled when the initial block is detected, and the adder 9 will not receive the delayed musical tone waveform data MD* as the second addition input. Therefore, the initial waveform data ID (FIG. 5C) currently read out from the waveform memory 6 is supplied as the musical tone waveform data MD to the sound system 12.

The envelope generator 11 receives the key on signal KON and the tone selection signal TC and generates the envelope signal EV having a waveform corresponding to the selected tone color in a time-division manner every time the key on signal KON is generated.

The operation of the electronic musical instrument shown in FIG. 2 will now be described. The operation for only one channel is described by way of simplicity. The same operation as in the selected channel can be performed in other channels in a time-division manner in synchronism with the corresponding channel timings.

When the depressed key is assigned by the key assigner 3 to the corresponding channel, the accumulator 5 and the block counter 26 are reset in response to the key on pulse signal KONP. The block designation output BL designates the 0th block. The accumulator 5 generates the accumulated output qF (FIG. 4A) updated one by one at a period corresponding to the pitch of the depressed key. The initial waveform data ID for 32 sampling points which are stored in the memory area assigned with the corresponding block (BL=0) corresponding to the 0th period 0T are read out from the waveform memory 6 in response to the block designation output BL and the accumulated output qF. In this case, the gate 16 is disabled in response to the output from the initial block detector 35, so that the initial waveform data ID of the respective sampling points pass through the adder 9 and are supplied as the musical tone waveform data MD to the sound system 12. Therefore, the tone having a tone color corresponding to the portion of the musical tone waveform MW (FIG. 5B) of the 0th period 0T is generated.

When data access in the 0th block (BL=0) for 32 sampling points is completed, the accumulated output qF changes from "11111" to "00000". In this case, the clock signal CA is supplied to the block counter 26 through the gate 27, so that the content of the block designation output BL designates the first block (BL=1). The memory area for the difference waveform data DD1 (FIG. 5C) of the block corresponding to the first period 1T is designated in the waveform memory 6. The difference waveform data DD1 of 32 sampling points are sequentially read out in response to the accumulated outputs qF. Therefore, the difference waveform data DD1 of the respective sampling points in the first period 1T are sequentially supplied from the waveform memory 6 to the adder 9. In this case, the initial block detector 35 does not detect the initial block, so that the gate 16 is enabled. Therefore, the musical tone waveform data MD (i.e., initial waveform data ID) stored in the corresponding shift registers among the shift registers 221 to 22Q of the one period delay circuit 15 are supplied as the delayed musical tone waveform data MD* (second addition input) to the adder 9 during the 0th period 0T. The adder 9 adds the differential waveform data DD1 of the first period 1T to the initial data ID of the 0th period 0T at the respective sampling points. As a result, the musical tone waveform data MD changing in the respective sampling points in the same manner as the portion of the musical tone waveform MW (FIG. 5B) in the first period 1T is generated.

When the data readout operation of the second block is completed, the accumulated output qF changes again from "11111" to "00000". The block counter 26 is started to generate the block designation output BL which designates the second block. In this case, the memory area for storing the difference waveform data DD2 of the second period 2T corresponding to the second block (FIG. 5C) is accessed in the waveform memory 6. The difference waveform data of the second period 2T are sequentially read out in units of sampling points in the same manner as in the first period 1T. The readout data are supplied to the adder 9 and are added with the delayed musical tone waveform data MD* from the one period delay circuit 15 in units of sampling points. The musical tone waveform data MD at the respective sampling points during the second period 2T are sequentially generated from the adder 9.

Every time the accumulated output qF from the accumulator 5 changes from "11111" to "00000" after the one-period (32 sampling points) designation is completed, the block counter 26 sequentially designates the following block. In this manner, all the difference waveform data DD at the respective sampling points during the corresponding period in the corresponding block are read out from the waveform memory 6. In this case, the difference waveform data DD at the sampling points during the given period are added by the adder 9 to the delayed musical tone waveform data MD* as the musical tone waveform data MD at the corresponding sampling points during the immediately preceding period, thereby calculating the musical waveform data MD of the respective sampling point of the given period. The resultant musical waveform data MD are supplied to the sound system 12 and the one period delay circuit 15. Therefore, the musical tone waveform of the successive periods can be produced.

When the block counter 26 completes the final block designation and is about to designate the next block (in practice, this block does not exist), the EOB detector 28 detects the EOB, so that the gates 27 and 8 are disabled. Therefore, the block counter 26 stops counting after the EOB designation is completed, and the adder 9 generates as the musical tone waveform data MD the delayed musical tone waveform data MD* from the one period delay circuit 15. As a result, the musical tone waveform data MD obtained from the adder 9 in the period corresponding to the EOB is repeatedly supplied to the sound system 12.

When the key is continuously depressed for a period of time longer than the periods of the waveform data which are stored in the waveform memory 6, the tone corresponding to the musical tone waveform data MD of the EOB can be repeatedly produced at the sound system 12.

According to the arrangement shown in FIG. 2, the waveform from the 0th period 0T to the final period of the musical tone waveform MW to be produced can be accurately produced. Only the waveform data of the 0th period 0T among the waveform data stored in the waveform memory 6 requires a larger number of bits. Only the difference waveform data (FIG. 5C) and the sampled values of the immediately preceding period are required for the subsequent periods. Therefore, the waveform memory can have a smaller capacity. In addition, in comparison with the conventional sample difference storage system (described in the Background of the Invention) for storing the waveform data of the 0th period 0T in the waveform memory, the memory capacity of this embodiment is greatly decreased. Thus, without impairing the sampled information obtained by sampling the waveform of a tone produced by a conventional musical instrument, the waveform memory can have a small capacity. Therefore, highly precise tones resembling the tones produced from a conventional musical instrument can be produced.

Second Embodiment

Figure 6:
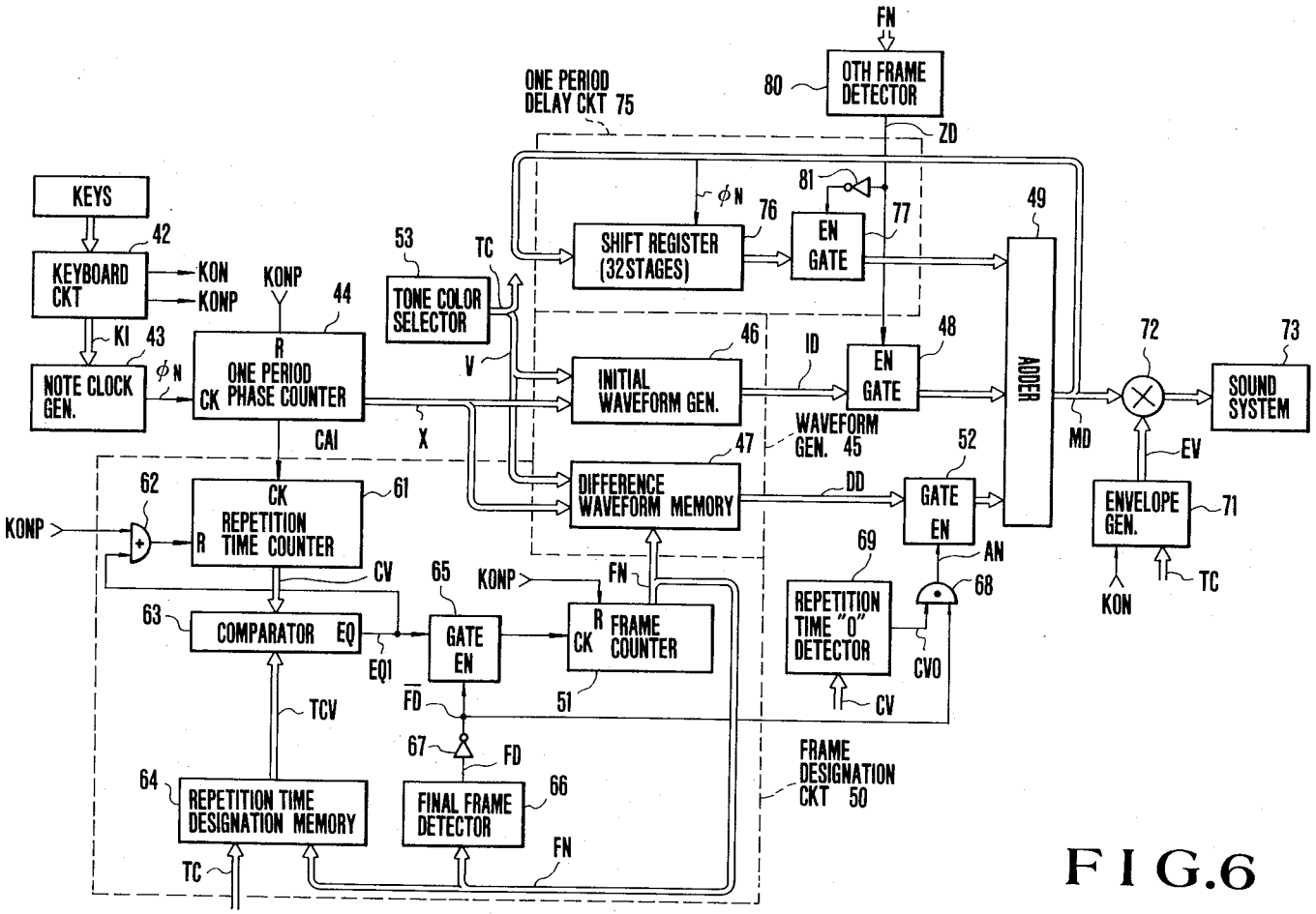
FIG. 6 is a block diagram of a musical tone producing device according to a second embodiment of the present invention.

FIG. 6 shows a second embodiment of a musical tone producing device according to the present invention. In this embodiment, the musical tone waveform MW from the beginning to the end shown in FIG. 7 are divided into a plurality of frames 0F, 1F, . . . each of which consists of a plurality of periods. The musical tone waveform MW changes in units of frames. Within a given frame, a waveform of one period is repeatedly produced, thereby further decreasing the capacity of the waveform memory.

In this second embodiment, the musical tone producing device is applied to a monophonic tone electronic musical instrument. When a player depresses one of the keys, a keyboard circuit 42 generates key information KI corresponding to the depressed key. The key information KI from the keyboard circuit 42 is supplied to a note clock generator 43. The note clock generator 43 supplies to a one period phase counter 44 a frequency signal $\phi$N as a clock signal corresponding to the pitch of the note specified by the depressed key in accordance with the key information KI from the keyboard circuit 42.

The frequency signal $\phi$N comprises a pulse signal having a frequency obtained by multiplying the number (32 in the second embodiment) of sampling points in one period with the frequency corresponding to the pitch of the specified note which is represented by the key information KI.

The one period phase counter 44 comprises a modulo-32 counter which receives as a reset signal a key on pulse signal KONP supplied from the keyboard circuit 42. The one period phase counter 44 counts pulses of the frequency signal $\phi$N after the key on pulse signal KONP is received. An output from the one period phase counter 44 is supplied as a phase signal X to a waveform generator 45.

The waveform generator 45 includes an initial waveform generator 46 and a difference waveform memory 47 which respectively comprise, for example, digital memories. The initial waveform generator 46 stores as initial waveform data ID the sampled values (of the musical tone waveform MW (FIG. 7) to be produced) of 32 sampling points of the first period among the plurality of periods in the 0th frame 0F. The initial waveform data ID of the 32 sampling points are sequentially read out in response to the phase signals X as address signals. The initial waveform data ID appearing at the output terminal of the initial waveform generator 46 is supplied as a first addition input to an adder 49 through a gate 48.

Figure 8:
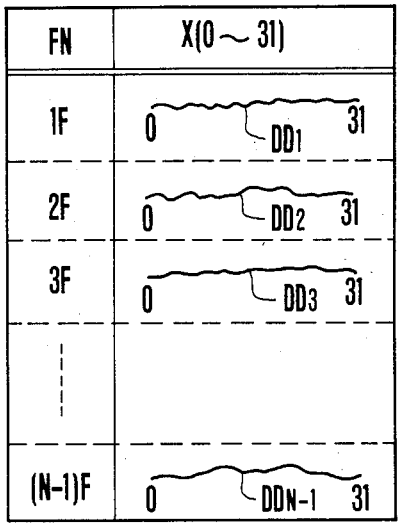
FIG. 8 shows a memory map of a difference waveform memory shown in FIG. 6.

The difference waveform memory 47 stores difference waveform data DD1, DD2, . . . and DD(N−1) of first to (N−1)th frames 1F to (N−1)F excluding the data of the 0th frame and the Nth frame. Each of the difference waveform data DD1, DD2, . . . , and DD(N−1) comprises data of 32 sampling points. The difference waveform data DD1 to DD(N−1) have contents obtained by subtracting the respective sampled values of the first period of the immediately preceding frame from the corresponding sampled values of the first period of the first frame, respectively. More particularly, the difference waveform data DD1 of the first frame 1F comprises differences obtained such that the sampled values of the first period of the frame 0F are subtracted from the corresponding sampled values of the first period of the frame 1F of the musical tone waveform MW (FIG. 7), respectively, as shown in the column corresponding to heading "IF" of FIG. 8. Similarly, the difference waveform data DD2 of the second frame 2F comprise differences obtained such that the sampled values of the first period of the frame 1F are subtracted from the corresponding sampled values of the first period of the frame 2F of the musical tone waveform MW (FIG. 7), respectively, as shown in the column corresponding to heading "IF" of FIG. 8.

In this manner, the difference waveform data of a given frame comprises differences obtained such that the sampled values of the first period of the immediately preceeding frame are subtracted from the corresponding sampled values of the first period of the given frame, respectively.

The difference waveform memory 47 for storing these difference waveform data is accessed by the phase signal X and a frame designation signal FN generated from a frame counter 51 in a frame designation circuit 50. The difference waveform data DD appearing at the output terminal of the difference waveform memory 47 is supplied as a second addition input to the adder 49 through a gate 52.

The initial waveform generator 46 and the difference waveform memory 47 store different types of waveform data ID and DD which correspond to the corresponding tone colors to be selected by a tone color selector 53. When a tone color selection signal TC is supplied from the tone color selector 53 to the initial waveform generator 46 and the difference waveform memory 47, the corresponding waveform data ID and DD can be read out therefrom.

The frame designation circuit 50 has a repetition time counter 61 operated in response to a count pulse signal CA1 from the one period phase counter 44. It should be noted that the count pulse signal CA1 comprises a carry signal when the one period phase counter 44 completes a cycle of supplying the waveform generator 45 with the phase signals X which sequentially specify the 32 sampling points within one period. Therefore, the repetition time counter 61 is reset in response to the key on pulse signal KONP as the reset signal supplied through an OR gate 62. Thereafter, every time the waveform generator 45 generates the waveform data ID or DD of one period, the repetition time counter 61 is incremented by one. A count output CV from the counter 61 is supplied as a comparison input to a comparator 63.

The comparator 63 also receives as a reference signal a repetition time designation signal TCV supplied to a repetition time designation memory 64. When the count output CV coincides with the repetition time designation signal TCV, the comparator 63 supplies a coincidence or equal signal EQ1 to the count input terminal of the frame counter 51 through a gate 65 and to the reset input terminal of the counter 61 through an OR gate 62.

The repetition time designation memory 64 stores frequency data of the respective tone colors from the first to (N−1)th frames (1F to (N−1)F) of the musical tone waveform MW to be produced. The repetition time designation memory 64 is accessed by the tone color selection signal TC and the frame designation signal FN generated from the frame counter 51. When the frame designation signals FN sequentially designate the 0th to (N−1)th frames (0F to (N−1)F), the corresponding frame repetition time data are read out, so that the corresponding designation outputs TCV are sequentially supplied to the comparator 63. Therefore, when the repetition times of each frame which are specified by the designation output TCV from the repetition time designation memory 64 coincide with the content of the count output CV from the repetition time counter 61, the comparator 63 generates the coincidence output EQ1. The frame counter 51 is incremented by one in response to the coincidence output EQ1, thereby updating the frame designation signal FN.

The frame designation signal FN from the frame counter 51 is supplied to a final frame detector 66. When the frame designation signal FN represents a final frame NF, the final frame detector 66 generates a detection output FD. The detection signal FD is inverted by an inverter 67, and an inverted signal $\overline{FD}$ is supplied to an enable terminal EN of the gate 65. The inverted signal $\overline{FD}$ is also supplied as a first conditional signal to a 2-input AND gate 68. When the frame designation signal FN designates the final frame NF, the gate 65 is disabled to stop the frame counter 51. At the same time, the AND gate 68 will not stop the delivery of the signal of logic "1".

The AND gate 68 receives a detection output CVO as a second conditional signal from a repetition time "0" detector 69. This detector 69 receives the count output CV from the repetition time counter 61 and performs zero detection when the count output CV represents count "0". In this case, the repetition time "0" detector 69 generates the detection output CVO of logic "1". The counter 61 is reset in response to the key on pulse signal KONP and the coincidence signal EQ1 when the frame is updated. Thereafter, until the first period of the updated frame is finished (i.e., until the output CA1 is generated), the count output CV is kept at "0". Therefore, throughout the first period of each of the 0th to (N−1)th frames, the AND gate 68 generates an AND output AN of logic "1". The AND output AN is supplied to an enable terminal EN of the gate 52, so that the gate 52 is enabled. The difference waveform data DD from the difference waveform memory 47 are gated through the gate 52 and can be subjected to addition by the adder 49.

The sum output from the adder 49 is supplied to a multiplier 72 and is multiplied with an envelope signal EV from the envelope generator 71. A multiplied output is supplied to a sound system 73 and a shift register 76 of a one period delay circuit 75. The shift register 76 has 32 stages corresponding to the 32 sampling points. The data in the shift register 76 are shifted in response to the frequency signal $\phi$N from the note clock generator 43. When one period has elapsed after the musical tone waveform data MD of a given sampling point are supplied to the shift register, delayed musical tone waveform data MD* are generated as a third addition input from the output terminals of the shift register 76 to the adder 49 through a gate 77. The difference waveform data DD read out from the difference waveform memory 47 are added to the one-period delayed musical tone waveform data MD* to obtain the current musical waveform data MD which are then supplied to the sound system 73.

The delayed musical tone waveform data MD* are supplied as the musical tone waveform data MD while the gate 52 is disabled.

The gates 77 and 48 are enabled/disabled in response to a detection output ZD from a 0th frame detector 80. The detector 80 receives the frame designation signal FN from the frame counter 51 and detects the 0th frame 0F when the frame designation signal FN designates the 0th frame 0F. In this case, the detector 80 generates the detection output ZD of logic "1". The gate 48 is enabled in response to this detection output ZD. At the same time, the detection output ZD is inverted by an inverter 81, and an inverted signal disables the gate 77. When the frame designation signal FN represents "0" (i.e., the 0th frame 0F), the initial waveform data ID from the initial waveform generator 46 is supplied to the adder 49. At the same time, the delayed musical tone waveform data MD* from the shift register 76 is not supplied to the adder 49.

However, when the frame designation signal FN does not represent "0", the detection output ZD goes to logic "0" to enable the gate 77 and disable the gate 48. In this case, the delayed musical tone waveform data MD* is supplied to the adder 49, but the adder 49 does not receive the initial waveform data ID.

In the above arrangement, when the player depresses a given key, and the keyboard circuit 42 generates the key information KI, the key on signal KON and the key on pulse signal KONP of the corresponding key, the one period phase counter 44, the repetition time counter 61 and the frame counter 51 are simultaneously reset in response to the key on pulse signal KONP, so that these counters are ready to begin counting. In this state, since the count of the frame counter 51 is set to be "0", the frame designation signal FN which represents the 0th frame 0F is generated. This frame designation signal FN is detected by the 0th frame detector 80, so that the gates 48 and 77 are enabled and disabled, respectively. In this state, the one period phase counter 44 starts counting in response to the frequency signal $\phi$N which is generated from the note clock generator 43 and which corresponds to the depressed key. The one period phase counter 44 generates the phase signal X, so that the initial waveform data ID of 32 sampling points of the first period of the 0th frame 0F are sequentially read out from the initial waveform memory 46 and are supplied to the adder 49.

On the other hand, the frame designation signal FN is supplied to the repetition time designation memory 64, and the designation output TCV which represents the number of times of repeating frequency is read out therefrom. The output TCV is supplied to the comparator 63. Meanwhile, the repetition time counter 61 counts the pulse signal CAl generated every time one cycle of phase signals X of the one period phase counter 44 is completed. As a result, the count output CV is incremented. Since the frame counter 51 does not perform counting until the comparator 63 generates the coincidence signal EQ1, the difference waveform data of the 0th frame 0F are repeatedly read out from the difference waveform memory 47 in response to the phase signals X.

When the repetition time counter 61 is reset in response to the key on pulse KONP, the count output CV thereof is reset to "0". This reset operation is detected by the repetition time "0" detector 69, so that the gate 52 is enabled during the first period of the 0th frame 0F. The difference waveform data read out from the difference waveform memory 49 are supplied to the adder 49 only during the first period and are added to the initial waveform data ID. However, since the difference waveform data of the 0th frame 0F which are stored in the difference waveform memory 47 are "0" (FIG. 8), the contents of the music tone waveform data MD as the sum from the adder 49 are the same as those of the initial waveform data ID generated from the initial waveform generator 46. Therefore, in the 0th frame 0R, the tones are generated on the basis of the initial waveform data ID repeatedly generated from the initial waveform generator 46.

When the 0th frame 0F has elapsed, and the coincidence signal EQ1 is generated from the comparator 63, the frame counter 51 is restarted to generate the frame designation signal FN which represents the first frame 1F. In this case, the designation content of the repetition time designation memory 64 is updated, so that the designation output TCV which designates the repetition times in the first frame 1F is generated from the memory 64. This output TCV is compared by the comparator 63 with the count output CV.

On the other hand, when the frame designation signal FN is updated, the difference waveform data DD1 of 32 sampling points in the first frame 1F are repeatedly read out from the difference waveform memory 47 as the difference waveform data DD. In this state, the count output CV from the repetition time counter 61 is set to be "0" during the first period of the first frame 1F. The count of "0" is detected by the repetition time "0" detector 69 which then generates the output CVO of logic "1". The gate 52 is enabled through the AND gate 68. Therefore, the difference waveform data DDl of 32 sampling points which are read out from the difference waveform memory 47 are sequentially added by the adder 49 only during the first period of the first frame 1F.

Meanwhile, since the content of the frame designation signal FN is updated to "1", the detection output ZD from the 0th frame detector 80 goes to level "0", thereby disabling the gate 48 and enabling the gate 77. In this case, the delayed musical tone waveform data MD* are supplied to the adder 49. The adder 49 adds the one-period delayed musical tone waveform data MD* (repeatedly generated initial waveform data ID in the 0th frame 0F) to the difference waveform data DD received through the gate 52 at the respective corresponding sampling points, so that the resultant musical waveform data MD appear at the output terminal of the adder 49 and are supplied to the sound system 73. Therefore, the sound system 73 generates the musical tone waveform which varies from the musical tone waveform of the 0th frame 0F by the difference waveform component of the first frame 1F.

In this state, the musical waveform data MD is delayed by one period by the shift register 76 of the one period delay circuit 75, so that the delayed musical tone waveform data MD* are fed back to the adder 49. In the second and subsequent periods, the count output CV from the repetition time counter 61 is updated to "1", "2", . . . . Every time the count output CV is updated, the output CVO from the repetition time "0" detector 69 rises to logic "1". The gate 52 is opened, so that the delayed musical tone waveform data MD* appear at the output terminal of the adder 49 as the musical waveform data MD. This state is kept until the next coincident signal EQ1 is generated from the comparator 63 (i.e., this state is maintained until the first frame 1F is finished). Therefore, the sound system 73 repeatedly generates tones by the number of times specified by the repetition time designation memory 64 in accordance with the single musical tone waveform.

In the same manner as described above, every time the coincidence signal EQ1 is generated from the comparator 63, the frame counter 51 is operated to update the frame designation signal FN. Therefore, the frame designation signals FN sequentially designate the second to (N-1)th frames (2F to (N-1)F). The difference waveform data DD read out from the difference waveform memory 47 at the first periods of the respective frames are added to the delayed musical tone waveform data MD* of the respective frames to obtain the resultant musical tone waveform data MD, respectively. Each data MD is repeated by the number of times specified by the repetition time designation memory 64. The sound system 73 generates the tones whose waveforms (tone colors) are sequentially changing from the second frame to the (N-1)th frames (2F to (N-1)F).

When the frame designation signal FN designates the final frame NF, it is detected by the final frame detector 66. The output from the final frame detector 66 is inverted by the inverter 67, and an inverted signal $\overline{FD}$ becomes logic "0", thereby disabling the gates 52 and 65. Therefore, the new difference waveform data DD are not subjected to addition by the adder 49, so that the delayed musical tone waveform data MD* are generated as the musical waveform data MD. The sound system repeatedly generates the musical tone waveform of the (N-1)th frame (N-1)F.

According to the arrangement shown in FIG. 6, the musical tone waveform MW (FIG. 7) to be produced is divided into a plurality of frames so as to produce the musical waveform data whose waveform (tone colors) sequentially change according to frame and to produce tones resembling natural musical tones. Therefore, the musical tone waveform data of all periods need not be stored in the difference waveform memory 47. As a result, the difference waveform memory 47 can have a smaller capacity than that shown in FIG. 2.

Modifications of First and Second Embodiments (1) In the first embodiment shown in FIG. 2, the waveform memory 6 may comprise two waveform memories for storing the initial waveform data ID and the difference waveform data DD, respectively.

(2) The first embodiment of FIG. 2 is exemplified by a polyphonic electronic musical instrument, but may be a monophonic tone electronic musical instrument.

(3) In the first embodiment shown in FIG. 2, the musical tone waveform data MD appearing at the output terminal of the adder 9 are used to obtain the musical tone waveform data MD at the sound system 12. However, the delayed musical tone waveform data MD* appearing at the output terminal of the selector 23 of the one period delay circuit 15 may also be used. In this case, the same effect as in the first embodiment can be obtained, except that the generation of the musical tone from the sound system 12 is slightly delayed.

Figure 9:
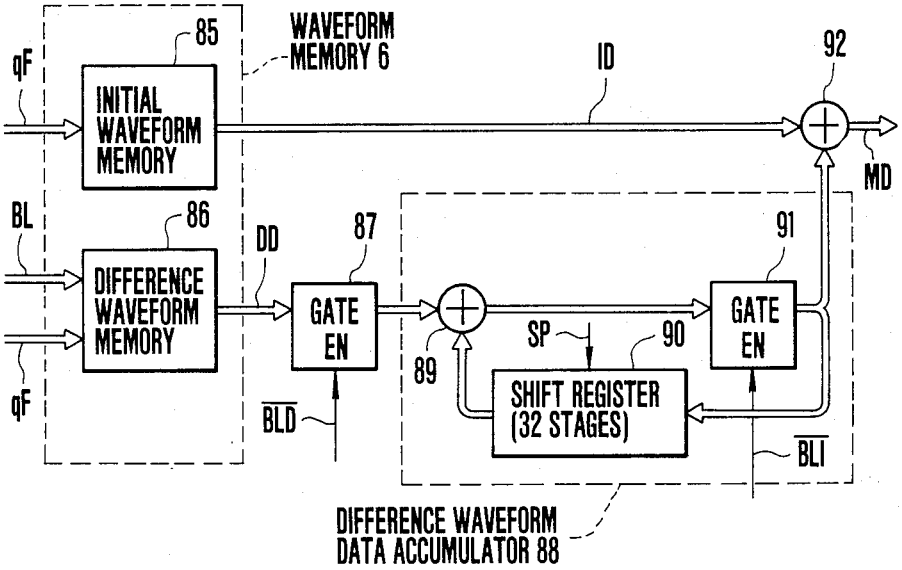
FIGS. 9 to 11 are block diagrams of modifications of the first embodiment, respectively.

(4) In the first embodiment of FIG. 2, the one-period delayed musical tone waveform data MD* are added to the difference waveform data DD read out from the waveform memory 6 to obtain the final musical tone waveform data MD. However, as shown in FIG. 9, the difference waveform data DD read out from the waveform memory 6 may be accumulated at every sampling point every time the block is updated (BL=0, 1, 2, . . . in FIG. 5C). In this case, the accumulated results are added to the initial waveform data ID to obtain the musical tone waveform data MD, respectively.

The modification shown in FIG. 9 is exemplified by a monophonic tone electronic musical instrument. The waveform memory 6 has an initial waveform memory 85 and a difference waveform memory 86. The initial waveform data ID of 32 sampling points which are stored in the initial waveform memory 85 are read out in response to the accumulated outputs qF from the accumulator 5 of FIG. 2. At the same time, the block areas of the difference waveform memory 86 are specified in response to the block designation outputs BL from the block counter 26, respectively, thereby sequentially reading out the difference waveform data DD. The difference waveform data DD read out from the difference waveform memory 86 are supplied to an adder 89 in a difference waveform data accumulator 88 through a gate 87.

The difference waveform data accumulator 88 has a 32-stage shift register 90 whose data is shifted in response to the shift pulse SP generated (from the qF variation detector 21) in correspondence to each sampling point. The output from the adder 89 is supplied to the input terminal of the shift register 90 through a gate 91 to delay the input by one period. The one-period delayed output is fed back to the adder 89. Every time the difference waveform data DD of 32 sampling points are sequentially received from the difference waveform memory 86 through the gate 87, the adder 89 accumulates the data at every sampling point. The accumulated results are supplied to an adder 92 through the gate 91 and are added to the initial waveform data ID read out from the initial waveform data ID in units of sampling points.

An output BLD from the EOB detector 28 is inverted by the inverter 29, and the inverted signal $\overline{BLD}$ is supplied as an enable signal to the gate 87. In this manner, when the final block is detected, the gate 87 is disabled. Thereafter, the same accumulated difference output is kept generated from the difference waveform data accumulator 88. The gate 91 receives an inverted signal BL1 obtained by inverting the signal BL1 from the initial block detector 35 and is disabled during the 0th block. Thus, the initial waveform data ID is generated as the waveform data MD during the first block.

When the arrangement of FIG. 9 is replaced with the arrangement consisting of the waveform memory 6, the gate 8, the adder 9, the one period delay circuit 15 and the gate 16, the same effect as in FIG. 2 can be obtained.

In the modification shown in FIG. 9, the monophonic tone waveform data MD is generated. However, polyphonic tone waveform data MD may also be generated in the same arrangement as in FIG. 2.

Figure 10:
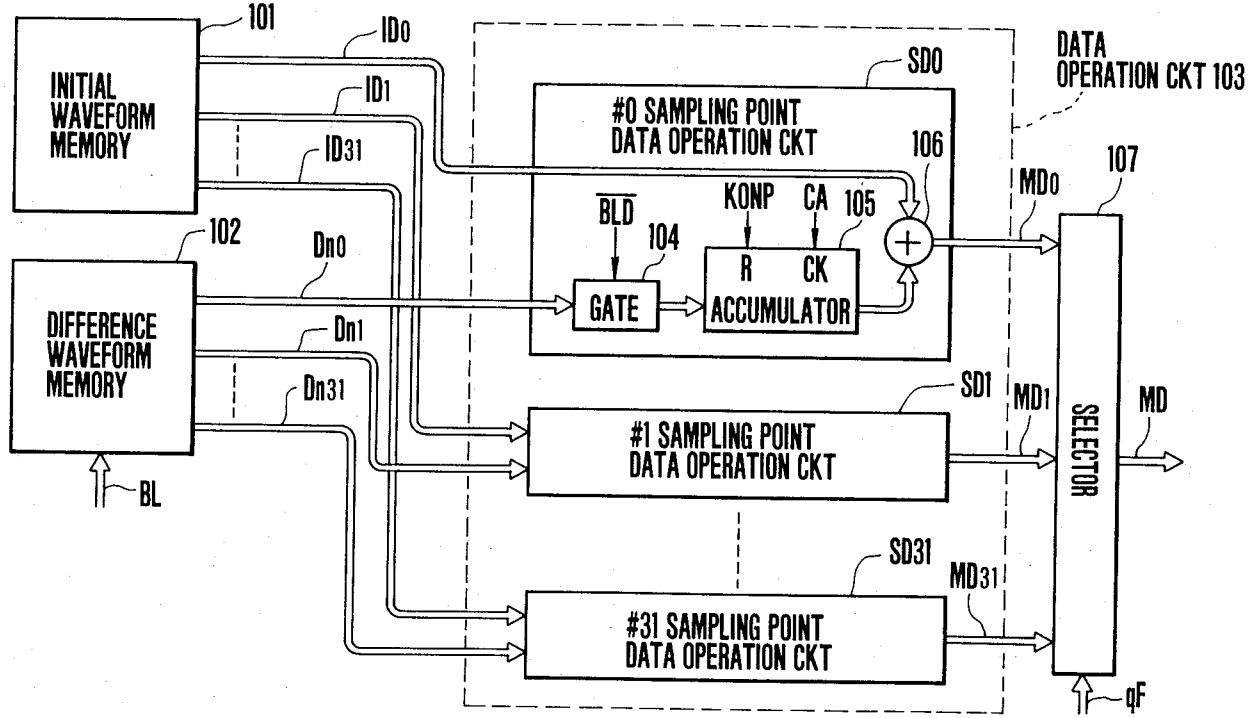

(5) In the first embodiment shown in FIG. 2, the delayed musical tone waveform data MD* of 32 sampling points are sequentially added to the difference waveform data DD of 32 sampling points in a time-division manner. However, parallel processing can be performed as shown in FIG. 10 when a single tone is generated. In this case, the initial waveform data ID0 to ID31 of 32 sampling points are parallel-accessed from an initial waveform memory 101. At the same time, difference waveform data Dn0, Dn1, . . . , and Dn31 of 32 sampling points are supplied to #0 to #31 sampling point data operation circuits SD0, SD1, . . . and SD31 of a data operation circuit 103 in units of blocks. The data are accumulated at every sampling point and are added to the initial waveform data ID0, ID1, . . . and ID31 in units of sampling points.

The sampling point data operation circuits SD0 to SD31 are exemplified by an arrangement for data processing of the first sampling point. The difference waveform data Dn0 (Dn1 to Dn31) is supplied to an accumulator 105 through a gate 104. The accumulator 105 is reset in response to the key on pulse signal KONP. Thereafter, the accumulator 105 starts accumulation in response to the clock signal CA from the accumulator 5 of FIG. 2. The accumulator 105 repeats accumulation operations at a timing (start timing of the next cycle) when a cycle of the periods 0T, 1T, T, . . . is completed. The accumulated result from the accumulator 105 is added by an adder 106 to the initial waveform data ID0 (ID1 to ID31), and resultant musical waveform sampling point data MD0 (MD1 to MD31) is supplied to a selector 107.

The selector 107 receives the accumulated output qF from the accumulator 5 and sequentially generates the data MD0, MD1, . . . , and MD31 in response to the corresponding accumulated outputs qF, thereby obtaining the musical tone waveform data MD. The same effect as in FIG. 2 can be obtained in the arrangement of FIG. 10.

The initial waveform data ID0 to ID31 in the sampling point data operation circuits SD0 to SD31 of FIG. 10 may be preset by the accumulator 5 in response to the key on pulse signals KONP, respectively. In this case, when the block is sequentially updated, the difference waveform data Dn0 to Dn31 are added to the the initial waveform data ID0 to ID31, respectively. The accumulated results are sequentially supplied to the selector 107.

The modification of FIG. 10 is exemplified by the generation of a monophonic tone, but can also be applied to the generation of a polyphonic tone signal.

Figure 11:
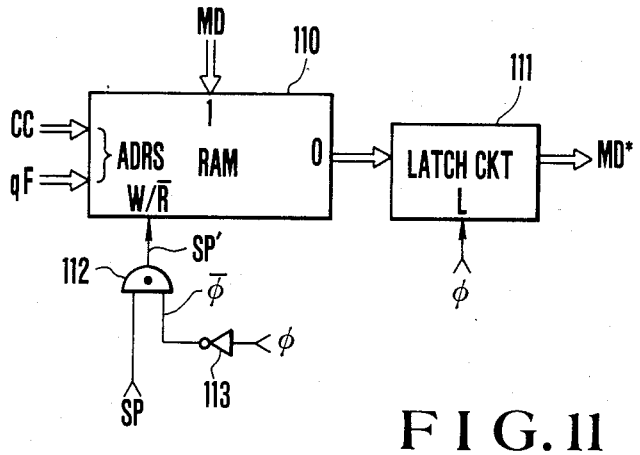

(6) A RAM 110 shown in FIG. 11 may be used in place of the shift registers 221 to 22Q in the one-period delay circuit 15 of the first embodiment of FIG. 2. Referring to FIG. 11, the RAM 110 has Q memory areas which correspond to Q channels and each of which can be selectively accessed in response to the channel signal CC (FIG. 3B). Each memory area has 32 memory locations (corresponding to 32 sampling points of one period of the musical waveform data MD) any one of which is accessed by the accumulated output qF from the accumulator 5. The channel signal CC and the accumulated output qF are supplied as address signals to the RAM 110. The musical tone waveform data MD as the write data are supplied from the adder 9 (FIG. 2). The read/write mode of the RAM 110 is controlled by a read/write signal SP' (signal SP' of logic "1" serves as a write signal; and signal SP' of logic "0" serves as a read signal). The data read out from the RAM 110 are supplied to a latch circuit 111 in response to the leading edge of the system clock $\phi$(FIG. 3A). The latched data are supplied as the delay musical waveform data MD* to the gate 16 of FIG. 2.

Figure 12:
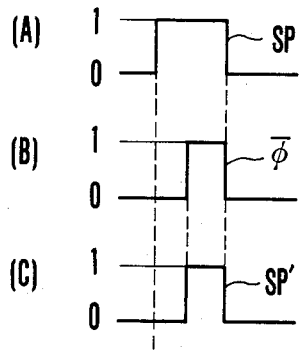
FIGS. 12A to 12C show waveforms of signals used in the modification shown in FIG. 11.

The read/write signal SP' is produced by an AND gate 112 as a logical product of the shift pulse SP from the qF variation detector 21 and an inverted clock $\phi$ is obtained by inverting the system clock $\phi$ by an inverter 113. The inverted clock $\phi$ rises (i.e., becomes logic "1") at a second half (FIG. 3B) of each of the channel period, as shown in FIG. 12B. The read/write signal SP' becomes logic "1" at the second half of the duration of the shift pulse SP (FIG. 12A), as shown in FIG. 12C so as to set the RAM 110 in the write mode. The RAM 110 is thus set in the read mode at the first half of the read/-write pulse SP'.

The musical waveform data MD stored at the memory location (accessed by the accumulation output qF) of the memory area (corresponding to the specified channel and accessed by the channel signal CC) is read out from the RAM 110 during the first half of the read/-write signal SP'. The readout data is latched by the latch circuit 111. During the second half of the read/-write signal SP' (i.e., when the read/write signal SP' goes to logic "1"), the musical waveform data MD from the adder 9 is stored in the corresponding memory location. The written data is accessed in response to the channel signal CC and the accumulation output qF when one period has elapsed. In this manner, the musical waveform data MD is delayed by one period and is produced as the one-period delayed musical tone waveform data MD*. The same effect as in FIG. 2 can thus be obtained.

(7) The second embodiment shown in FIG. 6 is exemplified by a monophonic electronic musical instrument, but can be a polyphonic electronic musical instrument.

(8) When the musical tone waveform MW (FIG. 7) to be produced is divided into the 0th to Nth frames (0F to NF), all the frames have the same length of time. Alternatively, the frame period may vary.

(9) As described with reference to FIG. 9, in the second embodiment shown in FIG. 6, the difference waveform data DD may be added to the initial waveform data ID from the initial waveform generator 46 while the difference waveform data DD sequentially read out the difference waveform memory 47 are accumulated so as to obtain the musical tone waveform data MD. In this case, referring to FIG. 9, the accumulated output qF is used as the phase signal X, the shift pulse SP is used as the frequency signal $\phi$N, the block designation output BL is used as the frame designation signal FN, the inverted output $\overline{BLD}$ comprises the output AN from the AND gate 68, the inverted signal $\overline{BL1}$ comprises the inverted signal ZD obtained by inverting the detection output ZD from the 0th frame detector 80.

(10) The modification of FIG. 10 can be employed in the second embodiment of FIG. 6. In this case, the accumulated output qF is the phase signal X, the block designation output BL is the frame designation signal FN, the inverted output $\overline{BLD}$ comprises the output AN from the AND gate 68, and the clock signal CA comprises the carry signal CA1 from the one period phase counter 44.

(11) The RAM 110 shown in FIG. 11 may be used in place of the shift register 76 in the one period delay circuit 75 of FIG. 6.

(12) In the first and second embodiments shown in FIGS. 2 and 6, respectively, the initial waveform data generated from the waveform memory 6 and the initial waveform generator 46 are respectively limited to one period. However, an initial waveform of ½ period, ¼ period or plural periods (e.g., two periods) may also be used. In this case, when the initial waveform of ½ period is used, the waveforms of first and second ½ periods are alternately assigned with positive and negative polarities so as to produce a waveform of one period. When the initial waveform of 2 periods is used, the accumulator 5 and the one period phase counter 44 must respectively generate the accumulated output qF and the phase signal X to designate the sampling points of two periods. Every time the initial waveform of two periods is generated, the clock signals CA and CA1 are generated. In addition, the difference waveform data must be stored in the waveform memory 6 and the difference waveform memory 47 in units of two periods, respectively. The shift registers 221 to 22Q and the shift register 76 must have a suitable number of stages so as to perform two-period delay, respectively. In addition to these modifications, in the second embodiment, the repetition time designation memory 64 (FIG. 6) must generate the designation data TCV which represents two periods.

(13) In the first and second embodiments shown in FIGS. 2 and 6, respectively, the scheme for storing the initial waveform data ID and the difference waveform data DD is not limited to PCM, but may be extended any coding scheme such as DPCM, DM, APCM, ADPCM and ADM.

(14) In the first and second embodiments shown in FIGS. 2 and 6, respectively, waveform memory type generators are used. However, the initial waveform data may be calculated and generated, and other waveform generation methods may be selectively used.

(15) In the first and second embodiments shown in FIGS. 2 and 6, respectively, the present invention is applied to the case wherein the musical tone signal is generated upon depression of a specific key or specific keys. However, the present invention can also be applied to the percussion instrument such as a drum to generate a percussion sound.

(16) In the first and second embodiments shown in FIGS. 2 and 6, respectively, the present invention is applied throughout the entire musical tone signal waveform. However, the present invention may also be applied to only a part of a musical tone. For example, when an attack portion subjected to complicated changes, waveform data representing a series of periods can be stored in the waveform memory in the same manner as in the conventional device. A portion excluding the attack portion may be subjected to the present invention. Alternatively, the tone signal of the attack portion may be produced according to the present invention, and the tone signal after the attack portion may be produced according to the conventional method.

In fine, according to the first or second embodiment of the present invention, the waveform amplitude data at the respective sampling points included in the unit waveform of blocks or frames and data of differences between the waveform amplitude data of the sampling points of the immediately preceding block or frame and the waveform amplitude data of the corresponding sampling points of the current block or frame are stored as the waveform data in the waveform memory. Therefore, the number of bits of the data stored in the waveform memory can be decreased.

In particular, according to the second embodiment, the musical tone waveform to be produced is divided into a plurality of frames each including a plurality of unit waveform portions. The waveform amplitude data of the respective sampling points included in the first unit waveform portion of each frame are calculated. At the same time, the musical tone waveform in the remaining unit waveform portions of the frame is repeatedly produced to greatly decrease the number of sampling points to be stored in the waveform memory, thereby further decreasing the capacity of the waveform memory.

Furthermore, even if the number of bits of the data stored in the small-capacity memory is decreased, the musical information (waveform of the natural tone produced by a conventional musical instrument) of the waveform will not be lost, thereby producing a highly precise tone with high quality.

FIGS. 13 to 18 show other embodiments of the present invention.

Third Embodiment

Figure 13:
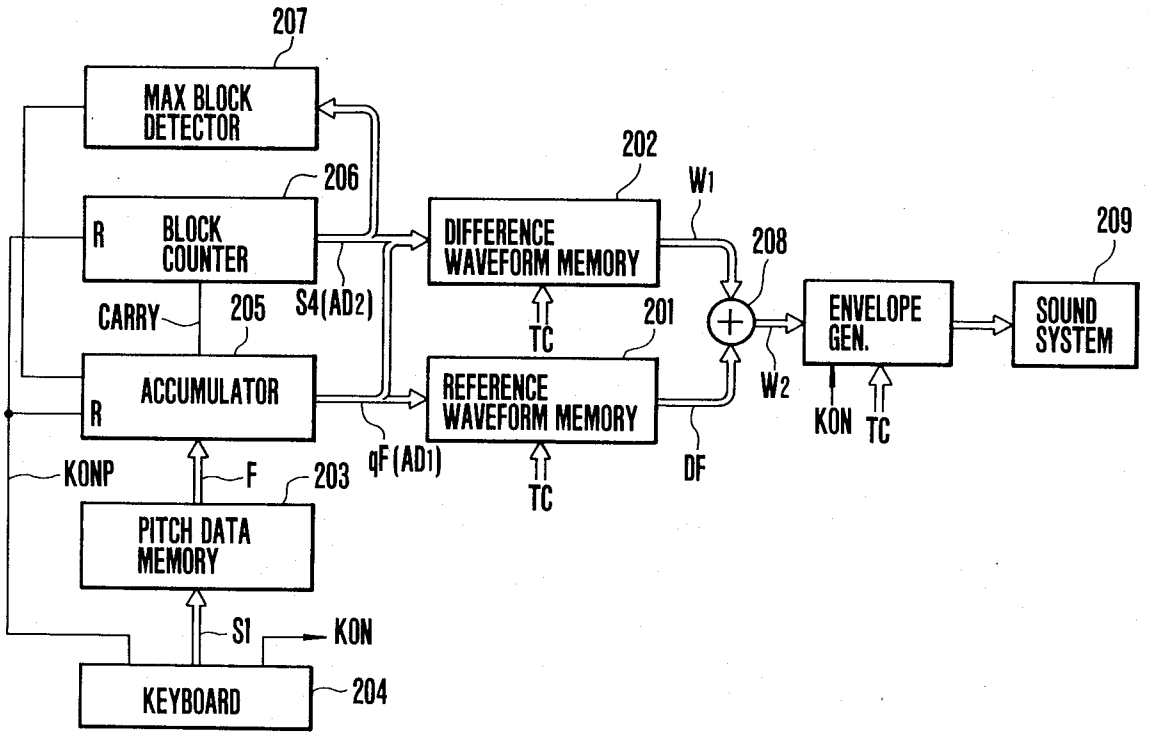
FIG. 13 is a block diagram of a musical tone producing device according to a third embodiment of the present invention.
Figure 15:
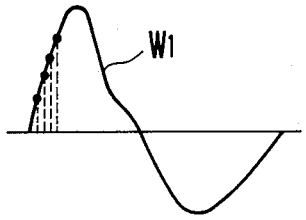
FIG. 15 shows a reference signal waveform.
Figure 16:
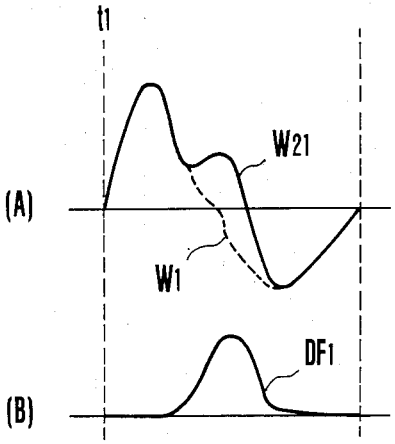
FIGS. 16A and 16B and FIGS. 17A and 17B respectively show waveforms of signals at times t1 and tn of FIG. 2.
Figure 17:
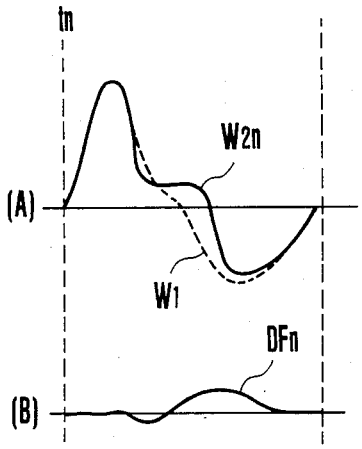

FIG. 13 is a block diagram of a musical tone producing device which is applied as an electronic musical instrument according to a third embodiment of the present invention.

Figure 14:
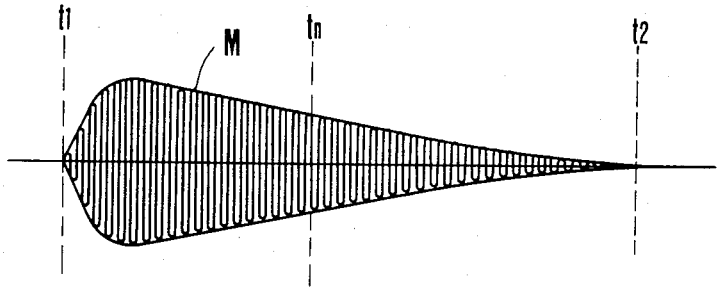
FIG. 14 shows a waveform of a musical tone generated by the device shown in FIG. 13.

Referring to FIG. 13, reference numeral 201 denotes a reference waveform memory for storing waveform data of a reference waveform. A musical tone waveform M of string instruments (e.g., piano, guitar), as shown in FIG. 14, is started from time t1 and is ended at time t2. The sampling point waveform data of one period of the reference waveform W1 (FIG. 15) repeatedly included from time tl to time t2 are stored at a series of consecutive addresses.

Reference numeral 202 denotes a difference waveform memory for storing difference waveform data. Data of differences between the sampling point waveform data of the musical tone waveform M from time tl to time t2 of FIG. 14 and the sampling point waveform data of the reference are stored at a series of addresses. The addresses of the difference waveform data are divided into a plurality of blocks each corresponding to one period for the addresses of the reference waveform data. The block address portions which respectively represent the first, block, the second block, the third block, . . . are assigned as the upper bits, and the lower bits are assigned to the same address portions as in the series of addresses of the reference data. Every time the address portions corresponding to the first block, the second block, the third block, . . . are accessed in the difference waveform memory 202, the addresses within the accessed block are accessed, so that the difference waveform data included in the corresponding blocks are read out in synchronism with the operation wherein the reference waveform data are repeatedly read out from the reference waveform memory 201.

Referring to FIG. 13, reference numeral 203 denotes a pitch numerical data memory. When key number data S1 is generated from a keyboard 204 upon depression of the corresponding key, it is supplied as an address signal to the pitch numerical data memory 203. The pitch numerical data memory 203 supplies numerical data F as accumulation data to an accumulator 205. Every time a key is depressed, the key on pulse KONP is generated from the keyboard 204 and is supplied as a clear signal to the accumulator 205. The accumulator 205 sequentially accumulates the numerical data F corresponding to the pitches of the depressed keys at a predetermined period. When the accumulator 205 performs accumulations once, twice, three times, . . . , the corresponding accumulated outputs qF are updated to 1F, 2F, 3F, . . . , respectively. These accumulated outputs qF are supplied as sampling point address signals ADl to the reference waveform memory 201 and the difference waveform memory 202.

When the accumulated contents of the accumulator 205 become maximum (bit data becomes all "1"), the accumulator 205 generates a carry signal CARY and is restarted. When the numerical data F is increased (i.e., when the pitch specified by the key is raised), the waveform data are read out from the memories 201 and 202 at a shorter period. The reference waveform data W1 and difference waveform data DF which correspond to the pitch specified by the depressed key are read out from the memories 201 and 202, respectively.

The carry signal CARY from the accumulator 205 is supplied to a block counter 206. The block counter 206 counts the carry signal CARY after it is cleared in response to the key on pulse KONP. A count output S4 from the block counter 206 is supplied as a block address signal AD2 to the difference waveform memory 202.

The count output S4 from the block counter 206 is supplied to a maximum block detector 207. The maximum block detector 207 detects the count output S4 when the output S4 represents a number exceeding a maximum block number Z among the blocks in the difference waveform memory 202. The maximum block detector 207 supplies an inhibition signal S5 to the accumulator 205 which is then disabled.

In this manner, the reference waveform data W1 read out from the reference waveform memory 201 are added by an adder 208 to the difference waveform data DF read out from the difference waveform memory 202 while the accumulator 205 continues the accumulation operation. A resultant musical tone signal W2 is supplied to a sound system 209 which converts the musical tone signal to musical tones.

When a player depresses a key at the keyboard 204 at time t1 in FIG. 14, the accumulator 205 and the block counter 206 are cleared in response to the key on pulse KONP. At the same time, the numerical data F corresponding to the pitch specified by the depressed key is read out from the pitch numerical data memory 203, so that the accumulator 205 accesses the addresses of the reference waveform memory 201 at a speed corresponding to the numerical data F. The accumulation operations are repeated by the accumulator 205 until the accumulated value becomes the maximum value and then the reference waveform data W1 (indicated by a dotted line in FIG. 16A) of one period are read out from the reference waveform memory 201 at a speed corresponding to the pitch of the tone specified by the depressed key. At the same time, the first block of the reference waveform memory 202 is accessed in response to the count output S4 from the block counter 206, and the addresses of the first block are accessed by the accumulated output qF from the accumulator 205. Therefore, the difference waveform data DF1 (FIG. 16B) of the first block are read out from the difference waveform memory 202.

The adder 208 adds the reference waveform data W1 and the difference waveform data DF1 to supply the musical tone signal W2 (also indicated by W21 in FIG. 16A) to the sound system 209.

When the accumulated content of the accumulator 205 exceeds the maximum value, the accumulator 205 supplies the carry signal CARY to the block counter 206 which is then counted up. The count output S4 from the block counter 206 represents the second block, and the accumulator 205 is started again. In the same manner, the data are read out from the memories 201 and 202 and are added to obtain the musical tone signal W2 which is then supplied to the sound system 209. In the same manner as described above, every time the block counter 206 is operated, the corresponding addresses of the reference waveform memory 201 are accessed. Therefore, difference waveform data DFn of an nth block corresponding to time tn of FIG. 14 which represent a different waveform from the difference waveform data DF1 (FIG. 17B) of the first block are added to the reference waveform data W1, thereby obtaining a musical tone signal W2 having a waveform Wln (FIG. 17A) which is different from that of the first block.

At time t2 in FIG. 14, the count output S4 from the block counter 206 exceeds the maximum value, and all data stored in the difference waveform memory 202 are read out, so that the accumulator 205 is disabled and tone generation is stopped.

According to the arrangement shown in FIG. 13, a musical tone generating device can be obtained wherein the waveform can change from the beginning to the end. A relatively large amplitude portion of the musical tone signal W2 is assigned to the reference waveform W1, and a relatively small amplitude portion is assigned to the difference waveform data DF1, . . . , DFn, . . . . Therefore, the total capacity of the waveform memories 201 and 202 can be greatly decreased as compared with the case wherein all the waveform data of the musical tone signal W2 are stored. For example, the large-amplitude reference waveform W1 is repeatedly read out from the reference waveform memory 201, thereby sufficiently decreasing the capacity of the memory.

When the reference waveform W1 is selected so as to minimize the amplitudes of the difference waveform data DF1, . . . , DFn, . . . , the memory capacity can be further decreased as a whole.

Figure 18:
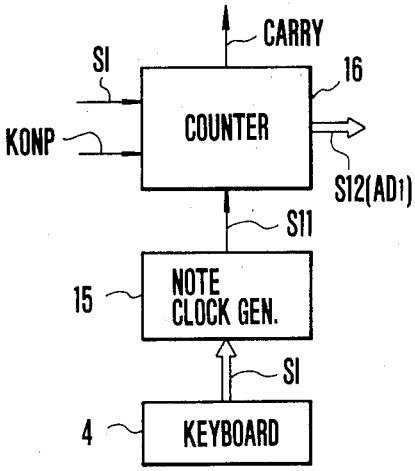
FIG. 18 is a block diagram of a musical tone producing device according to a fourth embodiment of the present invention.

FIG. 18 shows a fourth embodiment of the present invention. The arrangement of this embodiment is used in place of the pitch numerical data memory 203 and the accumulator 205 in FIG. 13. All other parts of the fourth embodiment are substantially the same as those of the third embodiment.

Referring to FIG. 18, key number data S1 generated at a keyboard 204 is supplied to a note clock generator 215 which generates a clock pulse S11 having a frequency corresponding to a pitch of the tone specified by the depressed key. The clock pulse S11 is supplied to a counter 216.

The counter 216 receives a key on pulse KONP as a clear pulse and is restarted from the all "0" state. The counter 216 receives a detection signal S5 as an inhibition signal from a maximum block detector 207. After the counter 216 is cleared in response to the key on signal KONP, the counter 216 supplies a count output S12 as an address signal AD1 to the reference waveform memory 201 and the difference waveform memory 202. Therefore, the count (address) of the counter 216 is updated at the speed corresponding to the pitch of the tone specified by the depressed key. The same operation and effect as in FIG. 13 can be obtained in this embodiment.

As described above, one-period waveform data are stored in the reference waveform memory 201. However, waveform data of a plurality of periods may also be stored and the same effect as described above is obtained.

According to each of the third and fourth embodiments of the present invention, there are provided a reference waveform memory from which the reference waveform data are repeatedly read out, and a difference waveform memory from which the difference data are sequentially read out. Therefore, a natural melody as in a conventional musical instrument can be produced on the basis of the waveform data stored in a small-capacity memory.

What is claimed is:

1. A musical tone producing device of a waveform readout type, comprising:

reference waveform memory means for storing reference waveform data constituting a reference waveform, said reference waveform being similar to each of divided waveforms belonging to a plurality of blocks into which a musical tone waveform of a musical tone to be produced is divided;

difference waveform memory means for storing difference waveform data which comprises a plurality of block difference waveform data, each of said block difference waveform data constituting difference waveform representing a difference between said reference waveform and each of said divided waveforms;

readout means connected to said reference waveform memory means and said difference waveform memory means for reading out said reference waveform data and for reading out successively said block difference waveform data;

adding means connected to said reference waveform memory means and said difference waveform memory means for adding said reference waveform data and each of said block difference waveform data and for outputting successively added results respectively corresponding to said divided waveforms; and sound means connected to said adding means for producing said musical tone according to said added results.

2. A musical tone signal producing device according to claim 1, wherein said readout means repetitively reads out said reference waveform data in response to the readout of each of said block difference waveform data.

3. A musical tone producing device according to claim 1, which further comprises:

pitch designating means for designating a pitch of said musical tone to be produced, said readout means reading out said reference waveform data and said block difference waveform data at a rate corresponding to said designated pitch.

4. A musical tone producing device according to claim 3, wherein said pitch designating means comprises a keyboard having a plurality of keys corresponding to different pitches respectively.

5. A musical tone producing device according to claim 1, wherein said readout means includes block designating means for designating one among said plurality of blocks, and reads out one relating to said designated block among said reference waveform data and said block difference waveform data.

6. A musical tone producing device comprising:

reference waveform memory means for storing reference waveform data constituting a reference waveform, said reference waveform being a divided waveform belonging to a first block among first to Nth blocks into which a musical tone waveform of a musical tone to be produced is divided, wherein N is a positive integer;

difference waveform memory means for storing second to Nth difference waveform data constituting second to Nth difference waveforms, Mth difference waveform among said second to Nth difference waveforms representing a difference between a divided waveform belonging to the Mth block and a divided waveform belonging to the (M-1)th block, wherein M is a positive integer greater than or equal to 2 and less than or equal to N;

readout means connected to said reference waveform memory means and said difference waveform memory means for reading out firstly said reference waveform data from said reference waveform memory means, and then for reading out successively said second to Nth difference waveform data fro said difference waveform memory means in order of the ordinal numbers of said second to Nth difference waveform data;

accumulating means connected to said reference waveform memory means and said difference waveform memory means for adding said reference waveform data to the sum of said second to Nth difference waveform data in order of the readout thereof and for outputting successively the accumulated result; and sound means connected to said accumulating means for producing said musical tone according to said accumulated result.

7. A musical tone producing device according to claim 6, which further comprises:

pitch designating means for designating a pitch of said musical tone to be produced, said readout means reading out said reference waveform data and said second to Nth difference waveform data at a rate corresponding to said designated pitch.

8. A musical tone producing device according to claim 7, wherein said pitch designating means comprises a keyboard having a plurality of keys corresponding to different pitches respectively.

9. A musical tone producing device according to claim 6, wherein said readout means includes block designating means for designating one among said first to Nth blocks, and reads out one relating to said designated block among said reference waveform data and said second to Nth difference waveform data.

10. A musical tone producing device according to claim 6, which further comprises:

tone color selecting means for selecting one among plural kinds of tone colors to be imparted with said musical tone; and wherein said reference waveform data comprises plural sets, each of which corresponds to each of said tone colors;

said second to Nth difference waveform data comprises plural sets, each of which corresponds to each of said tone colors;

said readout means reads out said reference waveform data and said second to Nth difference waveform data which are ones corresponding to said selected tone color among said respective sets.

11. A musical tone producing device according to claim 6, wherein said accumulating means comprises:

delaying means; and adding means for adding the output of said delay means and presently read out one among said second to Nth difference waveform data from said difference waveform memory means, causing said delay means delaying an added output by the time length of the block corresponding to said presently read out one.

12. A musical tone producing device comprising:

reference waveform memory means for storing reference waveform data constituting a partial reference waveform, said partial reference waveform being a partial waveform belonging to a predetermined period of a divided waveform belonging to first frame among first to Nth frames into which a musical tone waveform of a musical tone to be produced is divided, wherein N is a positive integer;

difference waveform memory means for storing second to Nth partial difference waveform data constituting second to Nth partial difference waveforms respectively, Mth partial difference waveform among said second to Nth partial difference waveforms representing a difference between a partial waveform belonging to the predetermined period of a divided waveform belonging to the Mth frame and a partial waveform belonging to the predetermined period of a divided waveform belonging to the (M-1)th frame, wherein M is a positive integer greater than or equal to 2 and less than or equal to N;

readout means connected to said reference waveform memory means and said difference waveform memory means for repetitively reading out said reference waveform data until the lapse of time corresponding to said first frame firstly, and then for repetitively reading out each of said second to Nth partial difference waveform data until the lapse of time corresponding to each of said second to Nth frames, the order of the readout of said second to Nth partial difference waveform being in order of the ordinal numbers of said second to Nth partial difference waveform data;

accumulating means connected to said reference waveform memory means and said difference waveform memory means for adding said reference waveform data to the sum of said second to Nth partial difference waveform data in order of the readout thereof and for outputting successively the accumulated result; and sound means connected to said accumulating means for producing said musical tone according to said accumulated result.

13. A musical tone signal producing device according to claim 12, wherein said readout means repetitively reads out said reference waveform data in response to the readout of each of said second to Nth partial difference waveform data.

14. A musical tone producing device according to claim 12, which further comprises:

pitch designating means for designating a pitch of said musical tone to be produced, said readout means reading out said reference waveform data and said second to Nth partial difference waveform data at a rate corresponding to said designated pitch.

15. A musical tone producing device according to claim 14, wherein said pitch designating means comprises a keyboard having a plurality of keys corresponding to different pitches respectively.

16. A musical tone producing device according to claim 12, wherein said readout means includes frame designating means for designating one among said first to Nth frames, and reads out one relating to said designated frames among said reference waveform data and said second to Nth partial difference waveform data.

17. A musical tone producing device according to claim 12, which further comprises:

tone color selecting means for selecting one among plural kinds of tone colors to be imparted with said musical tone; and wherein said reference waveform data comprises, plural sets, each of which corresponds to each of said tone colors;

said second to Nth partial difference waveform data comprises plural sets, each of which corresponds to each of said tone colors;

said readout means reads out said reference waveform data and said second to Nth partial difference waveform data which are ones corresponding to said selected tone color among said respective sets.

18. A musical tone producing device comprising:

reference waveform memory means for storing reference waveform data constituting a reference waveform in the form of a plurality of sampled values, said reference waveform being a divided waveform belonging to a first block among first to Nth blocks into which a musical tone waveform of a musical tone to be produced is divided, wherein N is a positive integer;

difference waveform memory means for storing second to Nth difference waveform data constituting second to Nth difference waveforms in the form of a plurality of sampled values respectively, Mth difference waveform among said second to Nth difference waveforms representing a difference between a divided waveform belonging to the Mth block and a divided waveform belonging to the (M-1)th block, wherein M is a positive integer greater than or equal to 2 and less than or equal to N;

readout means connected to said reference waveform memory means and said difference waveform memory means for reading out said reference waveform data from said reference waveform memory means and successively said second to Nth difference waveform data from said difference waveform memory means;

accumulating means connected to said reference waveform memory means and said difference waveform memory means comprising accumulators of a number corresponding to that of said sampled values, each of said accumulators accumulating corresponding sampled values of said reference waveform data and said second to Nth difference waveform data and for outputting successively the accumulated result; and sound means connected to said accumulating means for producing said musical tone according to said accumulated result.

19. A musical tone producing device according to claim 18, wherein said readout means simultaneously and in parallel reads out all the sampled values of said Mth difference waveform data and which further comprises selector means for sequentially sending out sampled values of said accumulated results.

* * * * *

UNITED STATES PATENT AND TRADEMARK OFFICE

CERTIFICATE OF CORRECTION

PATENT NO. : 4,641,564

DATED : 2/10/87

INVENTOR(S) : Okamoto

It is certified that error appears in the above-identified patent and that said Letters Patent is hereby corrected as shown below:

| COLUMN | LINE | DESCRIPTION |
|---|---|---|
| 18 | 15 | delete "T," insert --2T,-- |
| 18 | 64 | delete "Φ" insert --$\bar{\Phi}$-- |
| 18 | 66 | delete "Φ" insert --$\bar{\Phi}$-- |

Signed and Sealed this

Twenty-fifth Day of October, 1988

*Attest:*

DONALD J. QUIGG

*Attesting Officer*

*Commissioner of Patents and Trademarks*